US011519265B2

(12) United States Patent
Rowe et al.

(10) Patent No.: US 11,519,265 B2
(45) Date of Patent: Dec. 6, 2022

(54) WELL SYSTEM INCLUDING A DOWNHOLE PARTICLE MEASUREMENT SYSTEM

(71) Applicant: Halliburton Energy Services, Inc., Houston, TX (US)

(72) Inventors: Mathew Dennis Rowe, Spring, TX (US); Shaun Patrick Lawrence, Spring, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 42 days.

(21) Appl. No.: 17/214,420

(22) Filed: Mar. 26, 2021

(65) Prior Publication Data

US 2022/0307370 A1 Sep. 29, 2022

(51) Int. Cl.

| | |
|---|---|
| ***E21B 21/00*** | (2006.01) |
| ***E21B 21/01*** | (2006.01) |
| ***E21B 21/06*** | (2006.01) |
| ***E21B 49/00*** | (2006.01) |
| ***E21B 43/267*** | (2006.01) |
| ***E21B 43/34*** | (2006.01) |

(52) U.S. Cl.

CPC ..... *E21B 49/005* (2013.01); *E21B 21/001* (2013.01); *E21B 21/065* (2013.01); *E21B 43/267* (2013.01); *E21B 43/34* (2013.01)

(58) Field of Classification Search

CPC ..... E21B 21/001; E21B 21/01; E21B 21/065

See application file for complete search history.

(56) References Cited

U.S. PATENT DOCUMENTS

| | | | |
|---|---|---|---|
| 4,736,297 | A | 4/1988 | Lejeune |
| 5,663,559 | A | 9/1997 | Auzerais |
| 7,272,504 | B2 | 9/2007 | Akimov |
| 8,567,526 | B2 | 10/2013 | Johnston |
| 9,568,408 | B2 | 2/2017 | Jamison |

(Continued)

FOREIGN PATENT DOCUMENTS

| | | | |
|---|---|---|---|
| WO | 2017040667 | A1 | 3/2017 |
| WO | 2017102736 | A1 | 6/2017 |
| WO | 2018236373 | A1 | 12/2018 |

OTHER PUBLICATIONS

International Search Report and Written Opinion dated Nov. 12, 2021 for related PCT Application No. PCT/US2021/024654 filed Mar. 29, 2021.

*Primary Examiner* — Matthew R Buck

(74) *Attorney, Agent, or Firm* — K&L Gates LLP

(57) ABSTRACT

A well system for handling downhole particles. The well system may include a mud pump, a shaker including a corrugated shaker screen, a drill string, an imaging device, and a data acquisition system that may include a processor. The processor may be programmed to determine a cross-sectional area of a portion of the corrugated shaker screen occupied by the downhole particles in a first image of the images based on the first image, on a known profile of corrugations of the corrugated shaker screen and a known distance and angle between the imaging device and the corrugated shaker screen to determine a volume of the downhole particles on the portion of the corrugated shaker screen in the first image based on the cross sectional area occupied by downhole particles, a velocity of the downhole particles moving across the corrugated shaker screen, and an image generation rate.

20 Claims, 7 Drawing Sheets

(56) References Cited

U.S. PATENT DOCUMENTS

| | | | | |
|---|---|---|---|---|
| 9,651,468 | B2 | 5/2017 | Rowe et al. | |
| 9,857,289 | B2 | 1/2018 | Rowe | |
| 9,896,925 | B2 | 2/2018 | Hernandez | |
| 9,908,148 | B2 | 3/2018 | Forrione | |
| 9,912,918 | B2 | 3/2018 | Samuel | |
| 10,151,677 | B2 * | 12/2018 | Kulkarni | E21B 21/06 |
| 10,352,845 | B2 | 7/2019 | Rowe | |
| 10,577,912 | B2 * | 3/2020 | Torrione | E21B 49/005 |
| 10,633,941 | B2 | 4/2020 | Teodorescu | |
| 10,643,322 | B2 | 5/2020 | Holton et al. | |
| 10,655,408 | B2 | 5/2020 | Goloshchapova | |
| 10,781,680 | B2 | 9/2020 | Ciezobka | |
| 10,796,424 | B2 | 10/2020 | Parmeshwar | |
| 2007/0189119 | A1 | 8/2007 | Klotz | |
| 2012/0076364 | A1 | 3/2012 | Tjhang | |
| 2017/0056928 | A1 | 3/2017 | Torrione | |
| 2017/0056929 | A1 | 3/2017 | Torrione | |
| 2019/0368287 | A1 * | 12/2019 | Shekhar | G01B 21/22 |
| 2020/0332654 | A1 * | 10/2020 | Rowe | E21B 21/065 |
| 2020/0363289 | A1 | 11/2020 | Shekhar et al. | |
| 2021/0379511 | A1 * | 12/2021 | Scott | B01D 33/0376 |

* cited by examiner

WELL SYSTEM INCLUDING A DOWNHOLE PARTICLE MEASUREMENT SYSTEM

BACKGROUND

This section is intended to provide relevant background information to facilitate a better understanding of the various aspects of the described embodiments. Accordingly, these statements are to be read in this light and not as admissions of prior art.

Increasing the effectiveness of pumping, sweeping, drilling operations, fracturing operations, etc. can reduce the cost of hydrocarbon recovery operations. An approach to increasing the effectiveness of such operations is to observe the characteristic features of various particles returning to the Earth's surface from downhole during different hydrocarbon recovery operations.

Often, the returned particles are observed as they travel across a flat shaker screen. However, corrugated shaker screens are becoming increasingly common in the oilfield and the methods utilized to observe particles on a flat shaker screen cannot be used with corrugated shaker screens due to the ridges and grooves formed in the corrugated shaker screen.

BRIEF DESCRIPTION OF THE DRAWINGS

Embodiments of the well system including a downhole particle management system are described with reference to the following figures. The same numbers are used throughout the figures to reference like features and components. The features depicted in the figures are not necessarily shown to scale. Certain features of the embodiments may be shown exaggerated in scale or in somewhat schematic form, and some details of elements may not be shown in the interest of clarity and conciseness.

DETAILED DESCRIPTION

Figure 1:
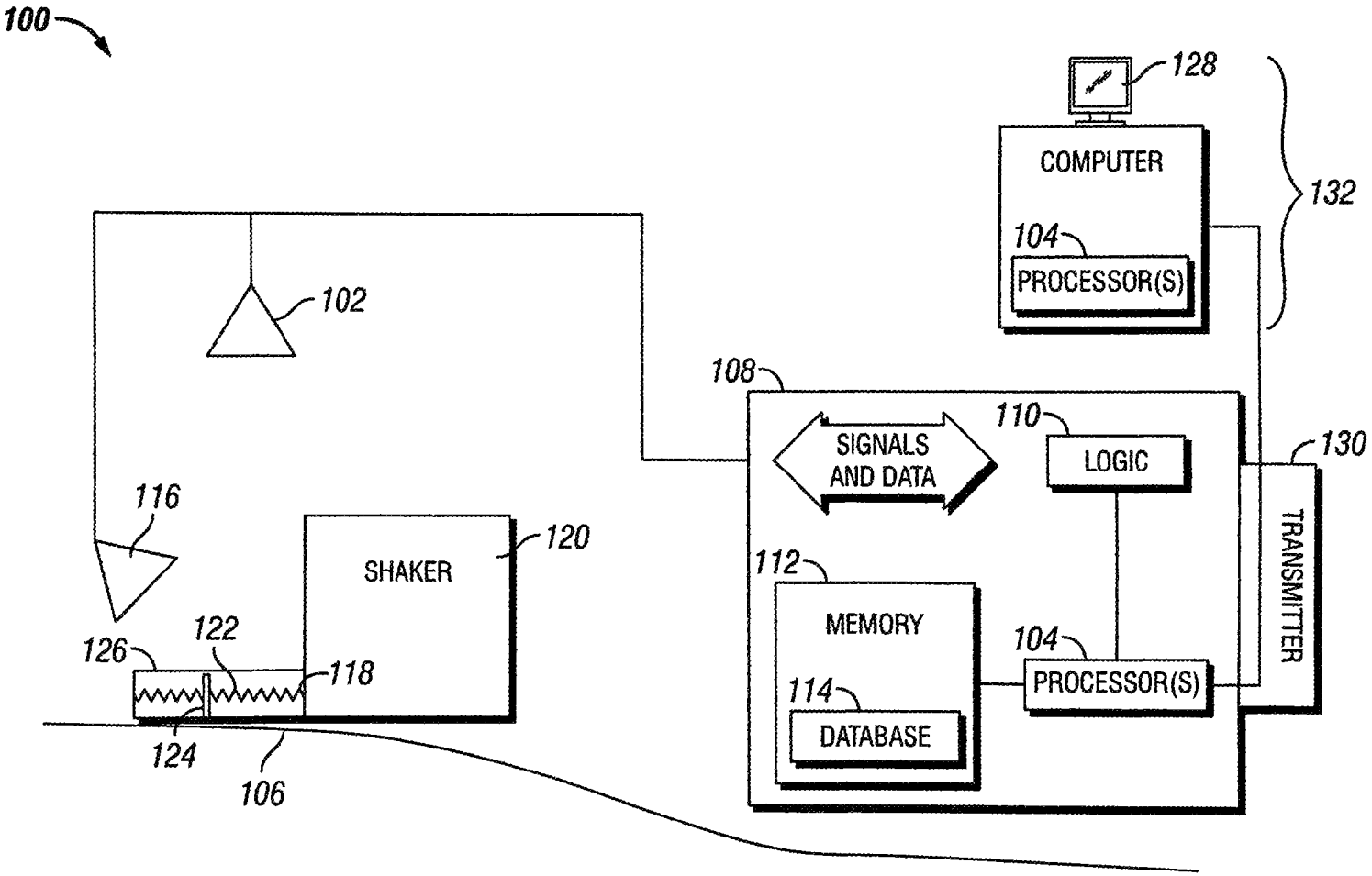
FIG. 1 is a block diagram of a system for determining a volume of downhole particles on a corrugated shaker screen, according to one or more embodiments.

The description that follows includes example systems, methods, techniques, and program flows that describe multiple embodiments. However, it is understood that this disclosure may be practiced without these specific details. For instance, this disclosure refers to drilling and fracturing operations for downhole particle analysis. Aspects of this disclosure can be also applied to any other applications that return downhole particles to the surface. In other instances, well-known instruction instances, protocols, structures and techniques have not been shown in detail in order not to obfuscate the description.

Various embodiments relate to processing and analyzing downhole particles returned to the Earth's surface from a borehole. For example, the downhole particles can be drill cuttings returning to the surface from downhole during drilling of the borehole. In another example, the downhole particles can be the proppants and any other particles (e.g., portions of the formation) that return to the surface during or after hydraulic fracturing operations.

Embodiments use one or more cameras, a corrugated shaker screen, and volume calculations to determine the volume of downhole particles per unit depth of the borehole. A projected or theoretical volume can be calculated based on parameters of the borehole being drilled (e.g., diameter). Additionally, the projected volume can be calculated as a function of time. At the surface of the borehole, downhole particles such as cuttings can be captured in a corrugated shaker screen, allowing the drilling fluid to be removed. The volume of the cuttings moving across the corrugated shaker screen over a selected period of time can then be measured. These volume measurements can be logged. Deviations from the projected or theoretical volume can be logged and parties can be notified on and/or off site of the borehole.

In some embodiments, results of this analysis can be used to alter various hydrocarbon recovery operations. For example, if the particles are received at the surface as a result of drilling operations, the drilling operations can be modified. For instance, the drilling can be stopped, or a direction of the borehole can be altered. Other examples of modified drilling operations can include replacement of parts of the drill string (e.g., the drill bit), a change in the weight of the drilling mud or flow rate, performing a borehole clean out, etc. For hydraulic fracturing operations, results of this analysis can be used to project the potential recovery of hydrocarbons from this current borehole. Additionally, results of this analysis can be used in drilling subsequent boreholes in a similar geographic region. For instance, if a level of proppants that are not retained in the formation is too high (returning to the surface instead), the direction or depth of the drilling of subsequent boreholes can be altered. Alternatively or in addition, the location or number of fractures in subsequent boreholes can be altered.

Tuning now to FIG. 1, FIG. 1 is a block diagram of an example system 100 for processing and analyzing downhole particles. The system 100 includes a combination of an imaging device 102 and one or more processors 104. The imaging device 102 and the processors 104 are located above the surface 106 of a geological formation. In one or more embodiments, the imaging device 102 and the processors 104 form part of a data acquisition system 108.

The system 100 also includes logic 110 that includes a programmable data acquisition subsystem. The logic 110 can be used to acquire images from the imaging device 102 and other data, such as information from downhole, including the depth of the drill bit during a drilling operation.

The system 100 also includes a memory 112 used to store the acquired images, as well as the other data (e.g., in a database 114). The memory 112 is communicatively coupled to the processor(s) 104.

In one or more embodiments, the imaging device 102 includes one or more cameras to be used in conjunction with one or more sources of illumination 116 to illuminate downhole particles 118 deposited on a shaker 120 that includes a corrugated shaker screen 122. The cameras are focused on the corrugated shaker screen 122 to capture images over time of downhole particles 118 as they move across one or more shakers 120.

The imaging device 102 is connected to the data acquisition system 108 that includes the logic 110, and then to a computer (comprising one or more processors 104). Alternatively, the imaging device 102 may connect directly to a computer. The images from the imaging device 102 can be analyzed in real-time. i.e., as they are generated by the imaging device 102, to provide the volume of the downhole particles 118 moving across a specified portion 124 of the corrugated shale shaker 122. In other embodiments, the images may be analyzed at a later time.

As part of the processing and analysis of the downhole particles 118, the distance between the imaging device 102 and the corrugated shaker screen 122 is measured. The distance measurement may be the distance between the imaging device 102 and a fixed point on the corrugated shaker screen 122 or the average distance between the imaging device 102 and the corrugated shaker screen 122. The angle between the imaging device 102 and a horizontal plane extending through the corrugated shaker screen 122 is also measured. Each image generated by the imaging device 102, along with the distance measurement, the angle measurement, and the predetermined profile of the corrugations on the corrugated shaker screen 122, is used to determine an actual cross-sectional area of the corrugated shaker screen 122 that is occupied by the downhole particles 118 at the specified portion 124 of the corrugated shaker screen 122 for the respective image.

The volume of the downhole particles 118 moving across the portion 124 of the corrugated shaker screen in an image can then be determined based on the occupied cross-sectional area of the portion 124 of the corrugated shaker screen 122 in the image, a rate at which images are generated, and the velocity of downhole particles 118 moving across the corrugated shaker screen 122. As a non-limiting example, if 30 images are generated every second, the volume of downhole particles associated with a single image can be calculated by multiplying the velocity, in units of distance per second, by the occupied cross-sectional area in the image and dividing the total by 30, the number of images per second. The cumulative volume of downhole particles moving across the corrugated shaker screen in a selected time period can then calculated by adding the volumes associated with each image over the selected time period.

The velocity of the downhole particles 118 may be determined using an approach of tracking a particle over a certain distance for a certain amount of time. For example, the imaging device 102 can be used to track one or more of the downhole particles 118 to determine velocity. Other methods, such as using a radar gun may also be used to determine velocity of particles. Additionally, inaccuracies due to vibration on the shaker 120 should be filtered out when determining velocity. This can be done by mounting a reference target on a static portion of the shaker 120 and capturing the pixel movement using the imaging device 102. Other methods, such as using accelerometers, may be used to determine vibrational movement of the corrugated shaker screen 122.

Figure 2:
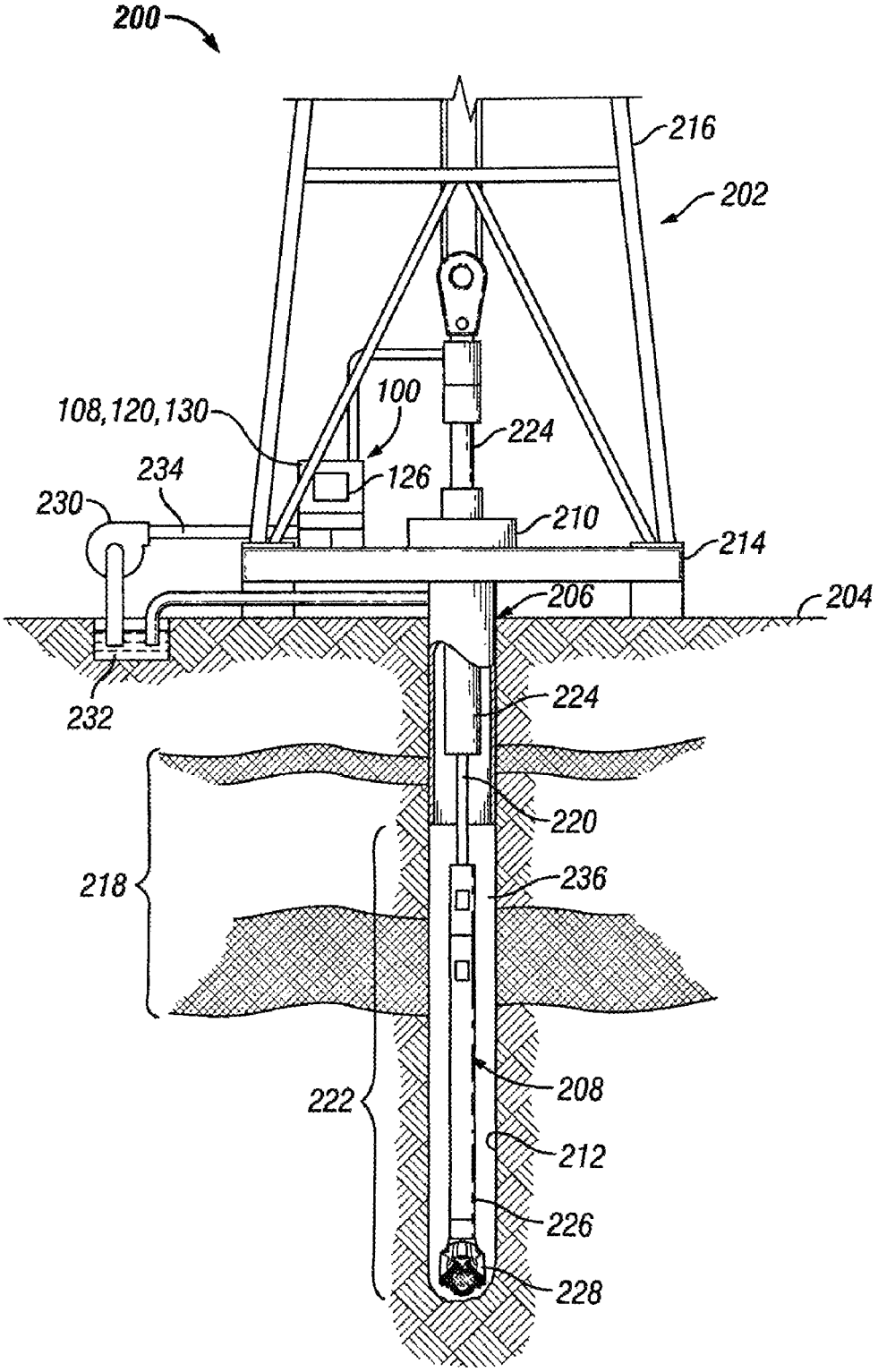
FIG. 2 is a schematic diagram of a well system disposed in a borehole, according to one or more embodiments.

Turning now to FIG. 2, FIG. 2 is a schematic diagram of a well system 200, according to one or more embodiments. As shown in FIG. 2, the well system 200 may include a drilling rig 202 located at the surface 204 of a well 206. Drilling of oil and gas wells is commonly carried out using multiple drill pipes connected together to form a drilling string 208 that is lowered through a rotary table 210 into a borehole 212. In the exemplary embodiment, a drilling platform 214 is equipped with a derrick 216 that supports a hoist.

The drilling rig 202 provides support for the drill string 208. The drill string 208 operates to penetrate the rotary table 210 for drilling the borehole 212 through subsurface formations 218. The drill string 208 include a, drill pipe 220, and a bottom hole assembly 222 located at the lower portion of the drill string 208. In one or more embodiments, the drill string may also include a kelly 224.

The bottom hole assembly 222 may include drill collars 224, a downhole tool 226, and a drill bit 228. The drill bit 228 is rotated to create a borehole 212 by penetrating the surface 204 and subsurface formations 218. The downhole tool 226 may comprise any of a number of different types of tools including MWD tools, LWD tools, and others.

During drilling operations, the drill string 208 may be rotated by the rotary table 210. In addition to, or alternatively, the bottom hole assembly 222 may also be rotated by a motor (e.g., a mud motor) that is located downhole. The drill collars 224 may be used to add weight to the drill bit 228. The drill collars 224 may also operate to stiffen the bottom hole assembly 222, allowing the bottom hole assembly 222 to transfer the added weight to the drill bit 228, and in turn, to assist the drill bit 228 in penetrating the surface 204 and subsurface formations 218.

During drilling operations, a mud pump 230 pumps drilling fluid (also known as "drilling mud") from a mud pit 232 through a hose 234 into the drill pipe 220 and down to the drill bit 228. The drilling fluid flows out from the drill bit 228 and the drilling fluid is returned to the surface 204 through an annular area 236 between the drill pipe 220 and the sides of the borehole 212. The drilling fluid may then be returned to the mud pit 232, where such fluid is filtered. In some embodiments, the drilling fluid can be used to cool the drill bit 228, as well as to provide lubrication for the drill bit 228 during drilling operations. Additionally, the drilling fluid may be used to remove downhole particles such as subsurface formation 218 cuttings created by operating the drill bit 228.

Referring now to FIGS. 1 and 2, the well system 200 includes a corrugated shaker screen 122 to receive drilling mud, and one or more image processing system 100 as described previously. The corrugated shaker screen 122 may also form part of the shaker deck 126. The image processing system 100 may be configured such that the imaging devices 102 have a field of view that includes the corrugated shaker screen 122, operating as described previously.

The processed data (e.g., downhole particle volume) can be displayed to show changes that have occurred and the operational conditions that are likely to be associated with those types of changes. Thus, the system 200 may include a display 128 to display the changes and the operational conditions. These conditions may be used to implement real-time control of the drilling operation (e.g., if falling shale is indicated by an increase in downhole particle volume, the weight on the bit may be reduced, or drilling may be halted entirely). The well system 200 may also include a transmitter 130 that is used to send the data (e.g., downhole particle volume) to a workstation 132, to generate an alarm, perform further processing/analysis, or for real-time operational control.

It should also be understood that the apparatus and systems of various embodiments can be used in applications other than for pumping and drilling operations, and thus, various embodiments are not to be so limited. The illustrations of system 100 and well system 200 are intended to provide a general understanding of the structure of various embodiments, and they are not intended to serve as a complete description of all the elements and features of apparatus and systems that might make use of the structures described herein.

Figure 3:
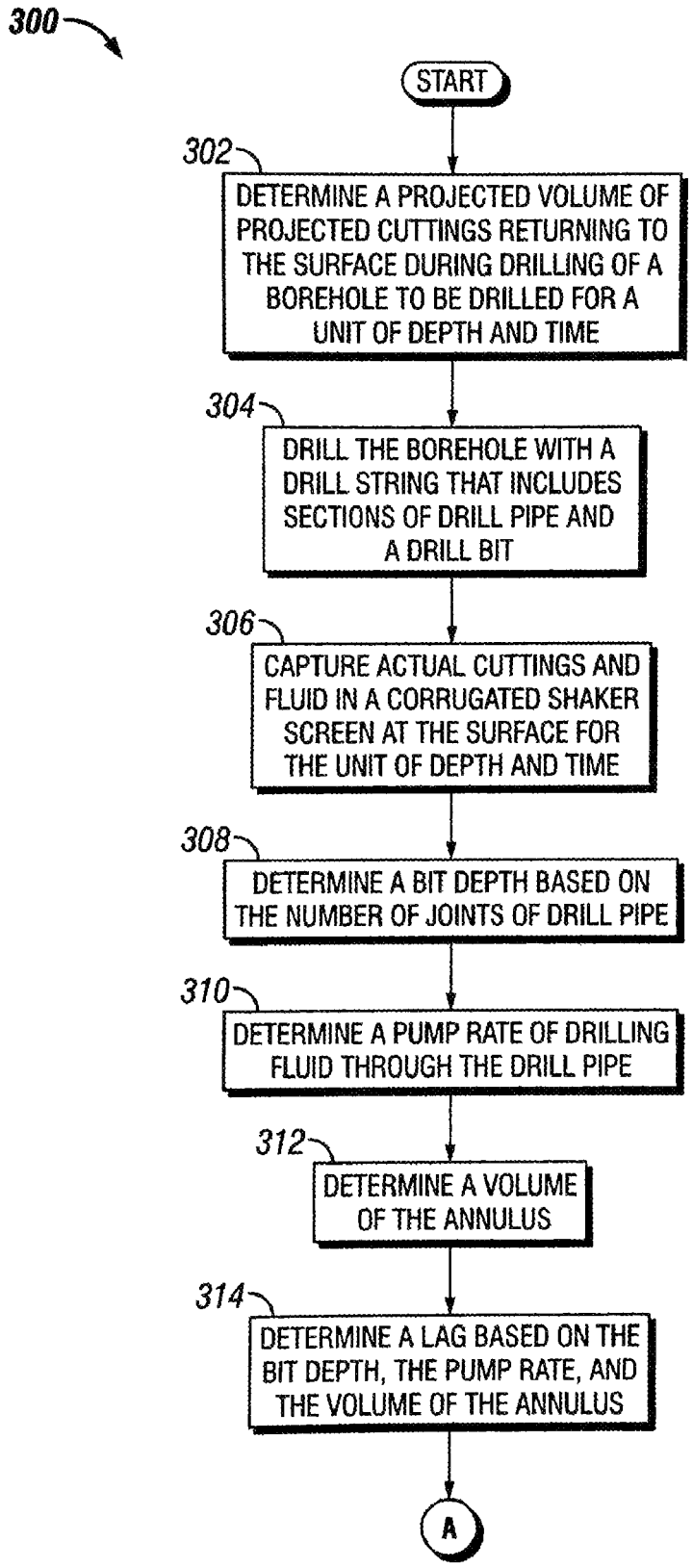
FIG. 3 is a flowchart of operations for evaluating and possibly altering downhole drilling operations based on analysis of volume of downhole cuttings, according to one or more embodiments.
Figure 4:
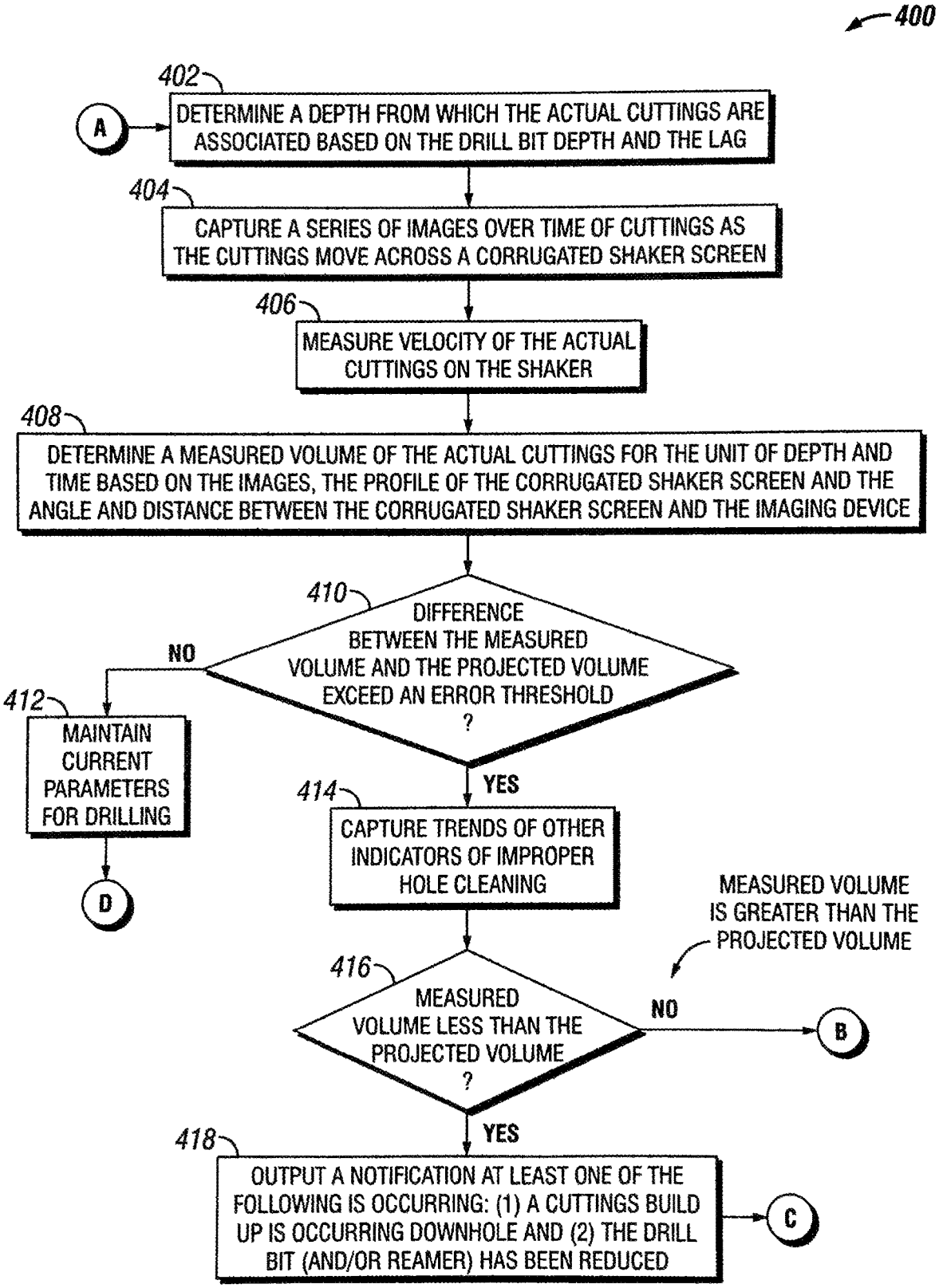
FIG. 4 is a continuation of the flowchart of FIG. 3.
Figure 5:
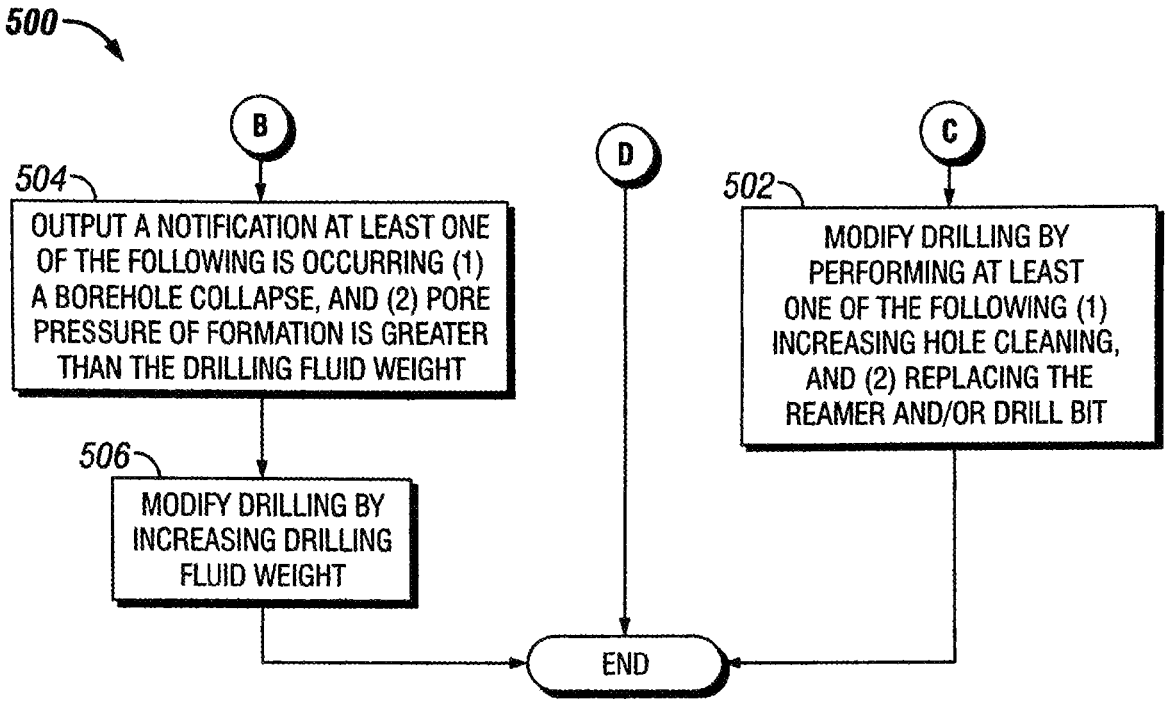
FIG. 5 is a continuation of the flowchart of FIG. 4.

Example operations of analyzing and using the volume of cuttings are now described. FIGS. 3-5 are flowcharts of operations for evaluating and possibly altering downhole drilling operations based on analysis of volume of downhole cuttings, according to some embodiments. Operations of flowcharts 300-500 of FIGS. 3-5 continue among each other through transition points A-D. Operations of the flowcharts 300-500 can be performed by software, firmware, hardware or a combination thereof. The operations of the flowchart 300 start at block 302.

At block 302, a projected volume of cuttings projected to return to the surface during drilling of a borehole for a unit of depth and time is determined. For example, with reference to FIGS. 1 and 2, the processors 104 calculate the projected volume of cuttings based on the determined unit of depth and time of drilling operations. The projected volume can also account for the size (e.g., diameter) of the drill bit 228 and/or reamer. The projected volume of cuttings for the determined depth and time interval may be calculated as a function of time.

To determine the depth that the downhole particles from which the cuttings originate downhole, bit depth and lag can be monitored. Bit depth can be derived from the amount of pipe in the borehole. For example, bit depth can be based on the number of joints of pipe in the hole and knowing the length of all the joints or by monitoring the draw works and determining how much the block has traveled while adding pipe to the borehole. Lag can be determined based on a location of the drill bit, the pump rate in either strokes or volume per unit of time, and the volume of the annulus.

When a foot of formation is drilled and knowing the bit and reamer size, the volume of formation can be calculated based on a unit of depth of the formation that has been drilled, the size of the drill bit, and size of the reamer. The return of this volume of formation to the surface can be determined based on the lag.

The camera system and software can measure the volume of rock returning to surface. The computer system may maintain a discrete or cumulative volume of cuttings per discrete depth interval or/and as a discrete cumulative volume of cuttings per discrete time. The data in the form of pictures and/or volumes may be stored at the well site and/or transmitted off site. If drilling fluid is not removed from the cuttings, an erroneous volume would be calculated. If shaker screens become flooded with cuttings or fluid, an erroneous volume would also be calculated. In some embodiments, the drilling fluid maintained on the cuttings will not calculated and no method will be used to remove wetting of cuttings. The drilling fluid left on cuttings can be considered an error of measurement.

At block 304, a borehole is drilled with a drill string that includes sections of drill pipe and a drill bit. For example, with reference to FIGS. 1 and 2, the drill bit 228 included on the bottom-most portion of the drill string 208 drills the borehole 212. The drill string 208 includes one or more sections of drill pipe 220.

At block 306, actual cuttings and fluid are captured in a corrugated shaker screen for the unit of depth and time of drilling. For example, with reference to FIGS. 1 and 2, cuttings from the subsurface formation 218 are created during operation of the drill bit 228. Drilling fluid is used to remove the cuttings. The drilling fluid and cuttings are returned to the surface 204 during drilling of the borehole 212 for the determined unit of depth and time. The corrugated shaker screen 122 receives the drilling fluid, which includes the cuttings. The drilling fluid may be filtered before or after it is received by the shaker screen 122 as to remove drilling fluid from the cuttings prior to analysis.

At block 308, a drill bit depth is determined based on the number of joints of drill pipe. The depth of the drill bit can be calculated if the number of joints of drill pipe and the lengths of each respective joint of drill pipe are known. For example, with reference to FIGS. 1 and 2, the depth of the drill bit 228 is determined based on the number of joints of drill pipe 220 and the known lengths of each of the drill pipe 220 joints.

At block 310, a pump rate of drilling fluid through the drill pipe is determined. The pump rate may be provided in pump strokes or volume of fluid pumped per minute. For example, with reference to FIGS. 1 and 2, the pump rate in addition to other drilling parameters may be stored in memory 112. The processors 104 may retrieve the pump rate from memory 112.

At block 312, a volume of the annulus is determined. For example, with reference to FIGS. 1 and 2, the processor 104 can calculate the volume of the annular area 236. The processor 104 may determine the volume based on the diameter of the borehole 212, diameter of the drill pipe 220, and the depth of the drill bit 228.

At block 314, a lag is determined based on the drill bit depth, pump rate, and volume of the annulus. The annular volume at the particular measured depth corresponding to the drill bit is determined based on the known drill bit depth and volume of the annulus. The lag can then be calculated using the resulting annular volume and the pump rate. For example, referring to FIGS. 1 and 2, the processors 104 can calculate the lag based on the depth of the drill bit 228, the volume of the annular area 236, and the pump rate of the mud pump 230. Operations of the flowchart 300 continue from transition point A to transition point A of the flowchart 400 shown in FIG. 4. From transition point A of the flowchart 400, operations continue at block 402.

At block 402, a depth from which the actual cuttings are associated is determined based on the drill bit depth and the lag. The depth of the drill bit may be tracked at each unit of depth and time. For instance, with reference to FIGS. 1 and 2 FIGS. 1 and 2, the processors 104 may retrieve from memory 112 the drill bit 228 depth recorded at the previous time that corresponds to the lag time. As an example, if the lag is determined to be 25 minutes and the current depth of the drill bit 228 is 5000 meters, the processor 104 may retrieve the drill bit 228 depth with a time stamp corresponding to 25 minutes prior.

At block 404, a series of images overtime of downhole particles, such as cuttings, are captured as the cuttings move across a corrugated shaker screen. For example, with reference to FIGS. 1 and 2, the imaging device 102 captures images of cuttings as the downhole particles travel across the corrugated shaker screen 122.

At block 406, the velocity of the actual cuttings on the shaker is measured. The velocity of the cuttings may be determined using traditional approach of tracking a particle over a certain distance for a certain amount of time. For example, with reference to FIGS. 1 and 2, the imaging device 102 in conjunction with a velocity capture algorithm can be used to track the velocity of the particle/cuttings. Other methods using radars may also be used to determine velocity of particles. To filter out noise in the form of vibration of the shaker 120, a reference target can be mounted on a static portion of the shaker. The pixel movement can be captured using the imaging device 102. An algorithm may be selected to capture the pixel movement on the shaker 120. Other methods using accelerometers may also be used to baseline the vibrations on the shaker screen.

At block 408, a volume of the actual cuttings is measured for the unit of depth and time based on the images generated by an imaging device, the rate of image generation, profile of the corrugations of the corrugated shaker screen, and the angle and distance between the corrugated shaker screen and the imaging device. The volume is calculated as described above with reference to FIGS. 1 and 2.

At block 410, it is determined whether the difference between the measured volume and the projected volume exceeds an error threshold. The error threshold indicates a deviation of the projected volume from the measured volume that can be attributed to error. The error threshold can account for drilling fluid that remains on cuttings after the cuttings are returned to the surface and deposited on the shaker screen. For instance, with reference to FIGS. 1 and 2, cuttings 118 that contain remnants of drilling fluid may be deposited onto the shaker screen 122. The drilling fluid that remains at the time of analysis of the cuttings 118 contributes to error of measurement and, therefore, is accounted for in the error threshold. The processors 104 can determine whether the error threshold is exceeded after calculating the difference between the measured volume and projected volume.

At block 412, if the difference between the measured volume and the projected volume does not exceed the error threshold, the current parameters for drilling are maintained. A difference between the measured volume of and the projected volume of cuttings, discrete or cumulative, which does not exceed the error threshold indicates that current drilling parameters are maintaining formation stability and safe conditions, For example, with reference to FIGS. 1 and 2, drilling of the borehole 212 with the drill bit 228 and/or reamer will be maintained with the current set of parameters, such as the drilling fluid weight. Operations of the flowchart 400 continue from transition point D to transition point D of the flowchart 500 shown in FIG. 5. From transition point D of the flowchart 500, operations are complete.

At block 414, if the difference between the measured volume and the projected volume exceed the error threshold, trends of other indicators of improper hole cleaning are captured. Other indicators of improper hole cleaning include changes in torque, drag, equivalent circulating density, and standpipe pressure. For instance, with reference to FIGS. 1 and 2, the processors 104 can obtain improper hole cleaning indicator data over a unit of depth and/or time for storage in memory 112. For example, the processors 104 may obtain current drilling parameters, mud weight, depth of the drill bit 228, etc. Data obtained for the time or depth interval can be input into calculations for determining values of the indicators (e.g., by calculating standpipe pressure). The combination of such indicators may be combined to create a positive indicator for improper hole cleaning.

At block 416, it is determined whether the measured volume is less than the projected volume. For example, with reference to FIGS. 1 and 2, the processors 104 may make the determination based on comparison of the measured volume and the projected volume. If the measured volume is greater than the projected volume, operations of the flowchart 400 continue from transition point B to transition point B of the flowchart 500 shown in FIG. 5. From transition point B of the flowchart 500, operations continue at block 504.

At block 418, if the measured volume is less than the projected volume, a notification or alarm is output. For instance, with reference to FIGS. 1 and 2, the processors 104 can generate the notification or alarm that is output to the display 128. The notification or alarm could indicate that a cuttings buildup is occurring downhole. This information, when coupled with information such as changes in torque, drag, equivalent circulating density, standpipe pressure, etc., can lead to a positive indicator for improper borehole cleaning. A buildup of cuttings indicates that hole cleaning efforts should increase. Poor hole cleaning could lead to pack off, increased bottom hole pressure, and/or possible formation fracture. The notification or alarm could also indicate that the drill bit and/or reamer has reduced in diameter. Reduction of the diameter of the drill bit and/or reamer may lead to bit trip. Operations of the flowchart 400 continue from transition point C to transition point C of the flowchart 500 shown in FIG. 5. From transition point C of the flowchart 500, operations continue at block 502.

At block 502, drilling is modified by increasing hole cleaning and/or replacing the reamer and/or drill bit. Hole cleaning may be increased due to receipt of a notification that a buildup of cuttings is occurring downhole. Additionally, the drill bit and/or reamer may be replaced as a result of receiving a notification that the drill bit and/or reamer has reduced in diameter. For example, with reference to FIGS. 1 and 2, the drill bit 228 is replaced to resolve the reduction in diameter resulting from drilling of the borehole 212. Cleaning of the borehole 212 may also be increased if cuttings from the subsurface formation 218 have built up in the borehole. Cleaning of the borehole 212 may be increased by adjusting the properties of the drilling fluid, increasing the flow rate, altering the penetration rate, etc.

At block 504, if the measured volume is greater than the projected volume, a notification or alarm is output. For instance, with reference to FIGS. 1 and 2, the processors 104 can generate the notification or alarm that is output to the display 128. The notification or alarm could indicate that the hole is collapsing and that mitigating efforts should be taken to stabilize the borehole. The notification or alarm could also indicate that the bore pressure has surpassed the drilling fluid weight.

At block 506, drilling is modified by increasing the drilling fluid weight. Drilling fluid weight should be increased as a result of identifying that the formation pore pressure is greater than the drilling fluid weight. For example, with reference to FIGS. 1 and 2, the density of the drilling fluid pumped from the mud pit 232 downhole can be increased (e.g., through addition of barite).

Figure 6:
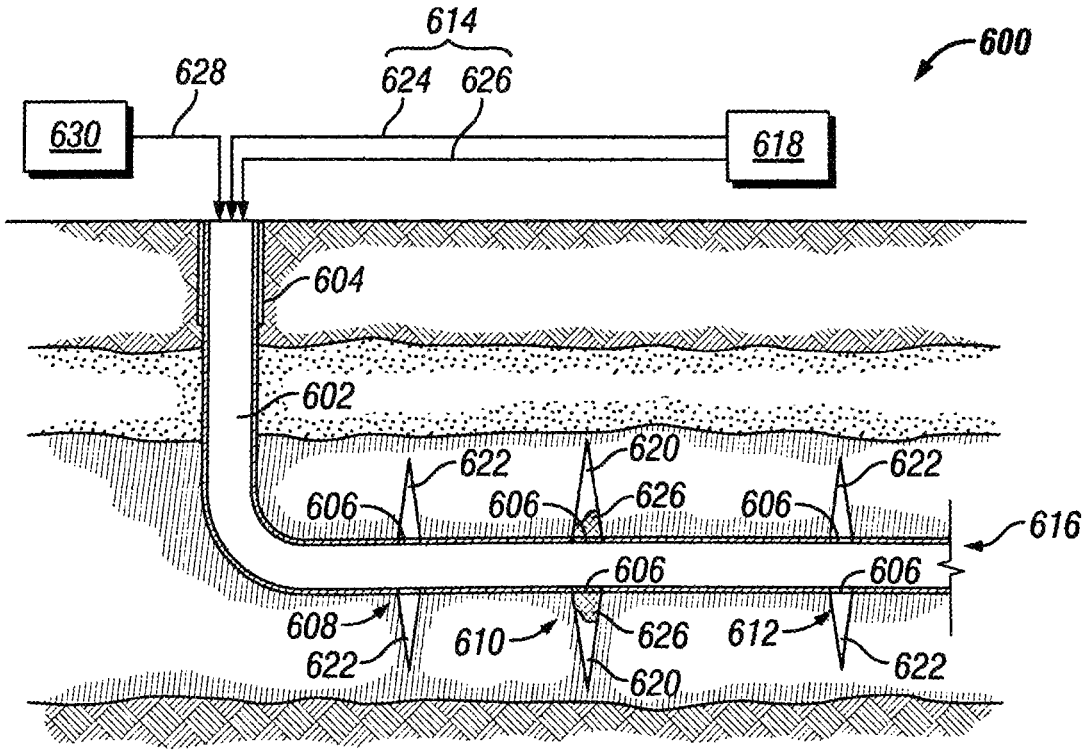
FIG. 6 is a schematic diagram of a fracturing operation, according to one or more embodiments.

Turning now to FIG. 6, FIG. 6 depicts a schematic diagram of a fracturing operation, according to some embodiments. In FIG. 6, a formation 600 composed of porous and permeable rocks that include hydrocarbons, e.g., in a reservoir, is located in an onshore environment or in an offshore environment. The formation 600 may be located in the range of a few hundred feet to thousands of feet below a ground surface. A borehole 602 is drilled to penetrate the formation 600 and to allow production of hydrocarbons from the formation 600.

The borehole 602 of FIG. 6 is formed at any suitable angle to reach the hydrocarbon portion of the formation 600. For example, the borehole 602 can follow a near-vertical, partially-vertical, angled, or even a partially-horizontal path through the formation 600. The borehole 602 may be lined with a protective lining 604 extending through the formation 600. The protective lining 604 can include a casing, liner, piping, or tubing and is made of any material, including steel, alloys, or polymers, among others. The protective lining 604 of FIG. 6 extends vertically downward and continues horizontally to further extend through the formation 600. In other examples, the borehole 602 can be completely or partially lined or fully open hole, i.e., without the protective lining.

Hydrocarbons are located in the pore volume space of the formation 600 and may be produced when the pore spaces are connected and permeability is such that the hydrocarbons flow out of the formation 600 and into the borehole 602. In some cases, the formation 600 may have low permeability, and the hydrocarbons do not readily flow, or production is hampered due to formation damage. To stimulate and to extract the hydrocarbons, a reservoir stimulation treatment program is initiated to break, fracture, or induce dilation of existing natural fractures in the rock of the formation 600. The reservoir stimulation treatment program can include perforating the protective lining 604, or installing stimulation specific protective lining equipment, to create formation entry points 606, e.g., perforations, sliding stimulation sleeves, etc. The formation entry points 606 provide a pathway for the hydrocarbons to flow from the formation 600 and into the borehole 602.

Mechanical isolation and compartmentalization tools can be used such that the formation entry points 606 segment the formation 600 into any number of production zones where fracturing programs can be carried out. As shown in FIG. 6, the formation 600 includes a first production zone 608, a second production zone 610, and a third production zone 612. Each zone 608, 610, 612 can be stimulated individually or simultaneously with other zones depending on the mechanical isolation and compartmentalization system employed. It should be understood that the number of zones in FIG. 6 is one example embodiment and that a wide variety of other examples, including increasing or decreasing the number of zones in the formation 600, are possible.

In one or more embodiments, the reservoir stimulation treatment program includes injecting proppant (such as a pressurized treating fluid 614) into the borehole 602 to stimulate one or more of the production zones 608, 610, 612. The treating fluid 614 can be stored in injection equipment 618, such as a storage tank or pipeline. The treating fluid 614 is pumped from the injection equipment 618 and into the borehole 602 with pressure greater than the fracture gradient or fissure opening pressure of the formation 600.

Other suitable programs can be used to flow the treating fluid 614 into the borehole 602, for example, via a conduit, such as coiled tubing or piping, located within the borehole 602. As the treating fluid 614 flows through the formation entry points 606, the increased pressure created by the flowing treating fluid 614 cracks the formation 600 to create or further widen a network of fractures 616. The network of fractures 616 of FIG. 6 may include high flow capacity fractures 620 and low flow capacity fractures 622. The high flow capacity fractures 620 are located in lower relative total stress areas of the stimulation interval where fluids from a conventional hydraulic fracturing treatment can be injected with little or no mechanical manipulation. The low flow capacity fractures 622 are located in higher relative total stress areas where little to no fluids from a convention hydraulic fracturing treatment would be injected without mechanical manipulation.

The treating fluid 614 includes a carrier fluid, i.e., a fracturing fluid 624, and may also include a stimulation material 626. The fracturing fluid 624 can include energized or non-energized water, brine, gels, cross-linked fluids, mineral or organic acids, non-aqueous based fluids, or any other type of fluids capable of fracturing the formation 600 and transporting the stimulation material 626 into the fractures 620, 622. The stimulation material 626 is suspended in the fracturing fluid 624 and settles into the high flow capacity fractures 620, or low flow capacity fractures 622 to hold the fractures open to permit the flow of hydrocarbons from the reservoir and into the borehole 602. The stimulation material 626 can include proppant, such as small spheres composed of sand, ceramic material, plastics, and resins, or other conductivity enhancement materials.

The treating fluid 614 may also include additives to optimize the fracturing program. The types of additives used can vary depending on the properties of the formation 600 and the composition of the treating fluid 614, among other factors. In particular, the additives can include stabilizers, surfactants, foamers, gel breakers, fluid loss additives, friction reducers, scale inhibitors, biocides, and pH control additives, and the like. In the embodiments, an additive (i.e., a flow constraint material (FCM) 628) can be stored in FCM injection equipment 630 to be injected into the borehole 602. Accordingly, the FCM 628 can flow simultaneously with the treating fluid 614 into the borehole 602. The FCM 628 can be a particulate, rheological, or chemical additive that partially constrains or redistributes the flow of the treating fluid 614 to a higher relative stress area, e.g., the low flow capacity fractures 622, without completely diverting the fluid 614 from the lower total stress area, e.g., the area where the high flow capacity fractures 620 are located.

Figure 7:
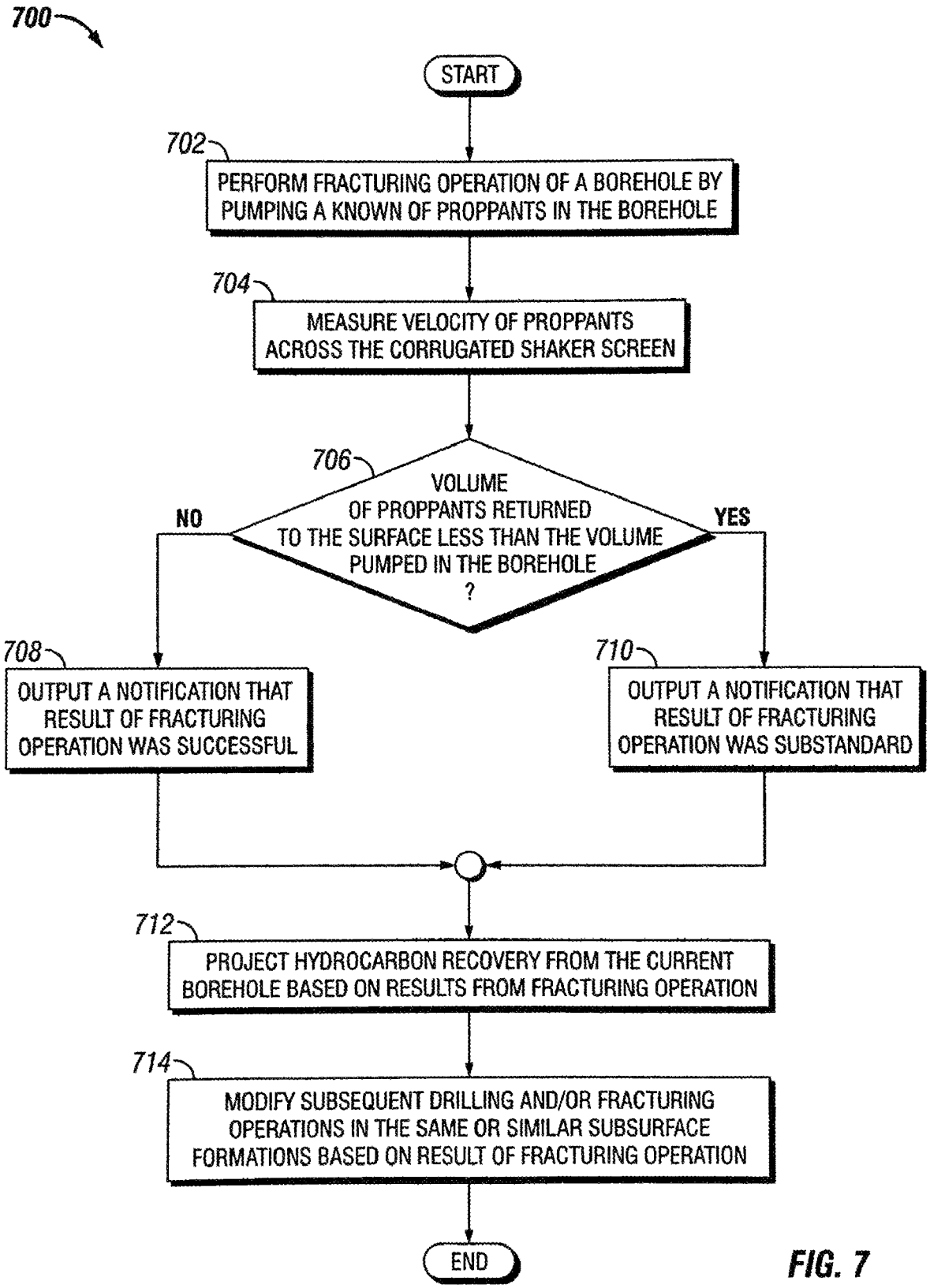
FIG. 7 is a flowchart of operations for evaluating and using results of a fracturing operation, according to one or more embodiments.

Example operations of analyzing and using downhole particles returned to the surface from fracturing operations are now described. FIG. 7 is a flowchart of operations for evaluating and using results of a fracturing operation, according to some embodiments. Operations of flowchart 700 can be performed by software, firmware, hardware, or a combination thereof. The operations of the flowchart 700 start at block 702.

At block 702, a fracturing operation of a borehole is performed by pumping a known volume of proppant (e.g., sand) in the borehole. For instance, with reference to FIG. 22, injection equipment 618 pumps fracturing fluid 624 into the borehole 602. The fluid 624 contains a known volume of proppant. Proppant may remain in the fractures 606 in the borehole 602 to keep the fractures 606 open.

At block 704, the velocity of the proppants across the corrugated shaker screen is determined. The velocity of proppants is determined with a process similarly used during velocity determination of downhole particles as described with reference to FIGS. 3-5.

At block 706, it is determined if the volume of proppant returned to the surface is less than the volume of proppant pumped in the borehole. The volume of proppant returned to the surface is determined with a process similarly used during volume analysis of downhole particles as described with reference to FIGS. 3-5. An error threshold for the volume of proppant returned to the surface may be enforced. If the volume of proppant returned to the surface exceeds the error threshold, the fracturing operations can be defined as not being properly performed. For instance, an error threshold of 10% of the initial volume may be established. If the volume of proppant returned to the surface exceeds 10% of the volume initially pumped into the borehole 602, it is determined that an insufficient amount of proppant remained in the fractures 606.

At block 708, if the volume of proppants returned to the surface is not less than the volume of proppants pumped in the borehole, a notification or alarm that indicates that the result of the fracturing operation was successful is output.

For instance, with reference to FIGS. 1 and 6, the processors 104 can generate the notification or alarm that is output to the display 128. A fracturing operation can be considered successful if essentially all of the proppants remain in the fractures 606 (e.g., the percent of the proppant pumped into the borehole 602 that is returned to the surface is within the error threshold).

At block 710, if the volume of proppants returned to the surface is less than the volume of proppants pumped in the borehole, a notification or alarm that indicates that the result of the fracturing operations was substandard is output. For instance, with reference to FIGS. 1 and 6, the processors 104 can generate the notification or alarm that is output to the display 128.

At block 712, hydrocarbon recovery from the current borehole is projected based on the results of the fracturing operation. The volume of proppant remaining in the borehole 602 as a result of fracturing may be used to determine projected hydrocarbon recovery. Subsequent operations to determine hydrocarbon recovery from fracturing operations can leverage the knowledge of the proppant remaining in the borehole 602 and/or the shapes and sizes of particles dislodged from and/or remaining in the formation 600.

At block 714, subsequent drilling and/or fracturing operations in the same or similar subsurface formations are modified based on the result of the fracturing operation. For instance, if a low volume of proppant remains in the fractures 606 (i.e., the volume of proppant returned to the surface exceeds the error threshold), subsurface formations with similar properties relative to the current formation may be avoided for subsequent fracturing operations. Completion of fracturing stages may also be altered.

Figure 8:
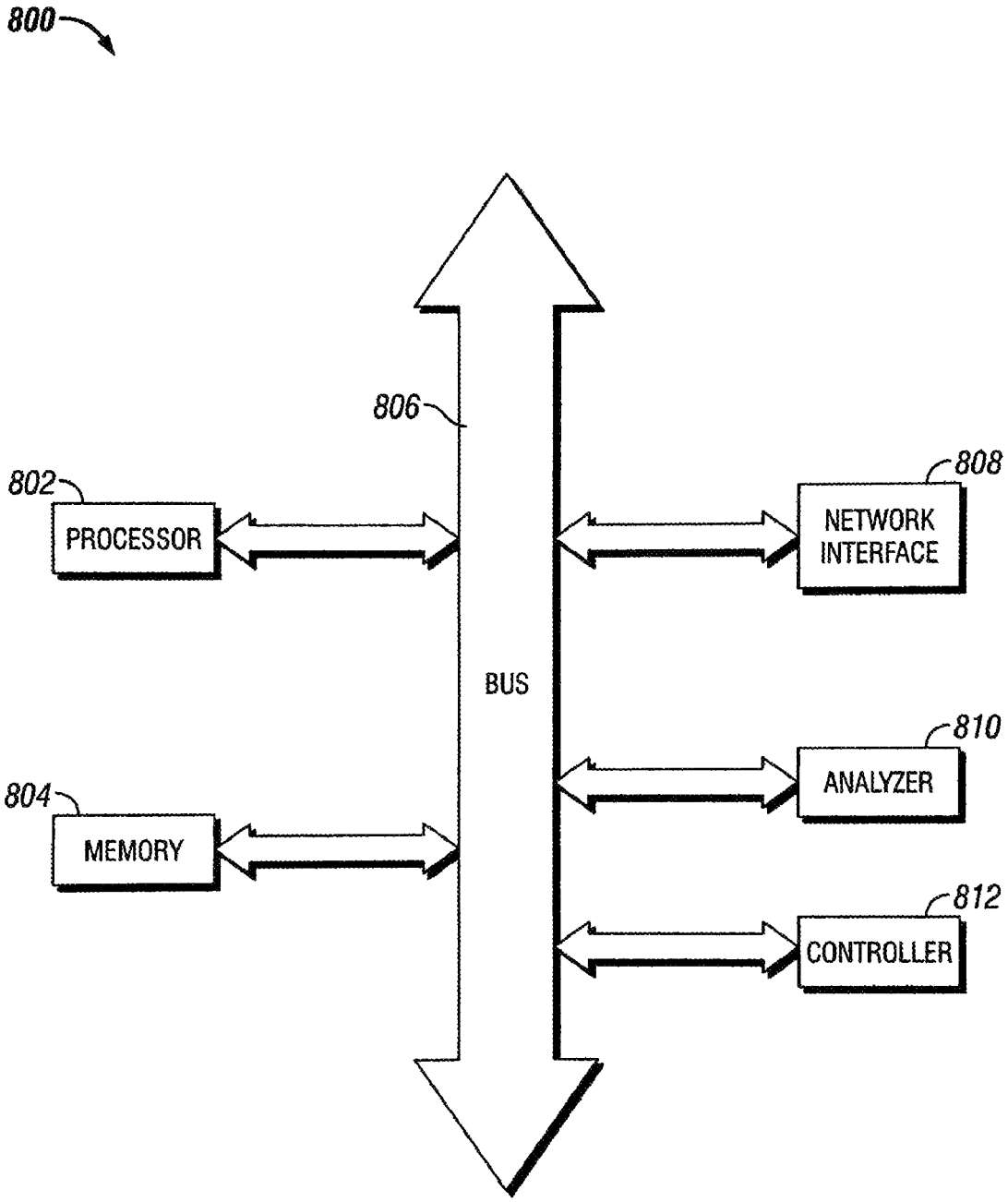
FIG. 8 is a block diagram of a computer, according to one or more embodiments.

Turning now to FIG. 8, FIG. 8 depicts a block diagram of an example computer 800, according to some embodiments. The computer 800 includes a processor 802 (possibly including multiple processors, multiple cores, multiple nodes, and/or implementing multi-threading, etc.). The computer includes memory 804. The memory 804 may be system memory (e.g., one or more of cache, SRAM, DRAM, zero capacitor RAM, Twin Transistor RAM, eDRAM, EDO RAM, DDR RAM, EEPROM, NRAM, RRAM, SONOS, PRAM, etc.) or any one or more of the above already described possible realizations of machine-readable media. The computer system also includes a bus 806 (e.g., PCI, ISA, PCI-Express, bus, NuBus, etc.) and a network interface 808 (e.g., a Fiber Channel interface, an Ethernet interface, an internet small computer system interface, SONET interface, wireless interface, etc.). While depicted as a computer, some embodiments can be any type of device or apparatus to perform operations described herein.

The computer also includes an analyzer 810 and a controller 812. The analyzer 810 can perform processing and analyzing of the downhole particles (as described above). The controller 812 can control the different operations that can occur in the response to results from the analysis. For example, the controller 812 can communicate instructions to the appropriate equipment, devices, etc. to alter the drilling operations. Any one of the previously described functionalities may be partially (or entirely) implemented in hardware and/or on the processor 802. For example, the functionality may be implemented with an application specific integrated circuit, in logic implemented in the processor 802, in a co-processor on a peripheral device or card, etc. Further, realizations may include fewer or additional components not illustrated in FIG. 8 (e.g., video cards, audio cards, additional network interfaces, peripheral devices, etc.). The processor 802 and the network interface 808 are coupled to the bus 806. Although illustrated as being coupled to the bus 806, the memory 804 may be coupled to the processor 802.

It will be understood that each block of the flowchart illustrations and/or block diagrams, and combinations of blocks in the flowchart illustrations and/or block diagrams, can be implemented by program code. The program code may be provided to a processor of a general purpose computer, special purpose computer, or other programmable machine or apparatus.

As will be appreciated, aspects of the disclosure may be embodied as a system, method or program code/instructions stored in one or more machine-readable media. Accordingly, aspects may take the form of hardware, software (including firmware, resident software, micro-code, etc.), or a combination of software and hardware aspects that may all generally be referred to herein as a "circuit," "module" or "system." The functionality presented as individual modules/units in the example illustrations can be organized differently in accordance with any one of platform (operating system and/or hardware), application ecosystem, interfaces, programmer preferences, programming language, administrator preferences, etc.

Any combination of one or more machine readable medium(s) may be utilized. The machine-readable medium may be a machine-readable signal medium or a machine-readable storage medium. A machine-readable storage medium may be, for example, but not limited to, a system, apparatus, or device, that employs any one of or combination of electronic, magnetic, optical, electromagnetic, infrared, or semiconductor technology to store program code. More specific examples (a non-exhaustive list) of the machine-readable storage medium would include the following: a portable computer diskette, a hard disk, a random access memory (RAM), a read-only memory (ROM), an erasable programmable read-only memory (EPROM or Flash memory), a portable compact disc read-only memory (CD-ROM), an optical storage device, a magnetic storage device, or any suitable combination of the foregoing. In the context of this document, a machine-readable storage medium may be any tangible medium that can contain, or store a program for use by or in connection with an instruction execution system, apparatus, or device. A machine-readable storage medium is not a machine-readable signal medium.

While the aspects of the disclosure are described with reference to various implementations and exploitations, it will be understood that these aspects are illustrative and that the scope of the claims is not limited to them. In general, techniques for processing and analyzing of particles from downhole as described herein may be implemented with facilities consistent with any hardware system or hardware systems. Many variations, modifications, additions, and improvements are possible.

A machine-readable signal medium may include a propagated data signal with machine readable program code embodied therein, for example, in baseband or as part of a carrier wave. Such a propagated signal may take any of a variety of forms, including, but not limited to, electromagnetic, optical, or any suitable combination thereof. A machine-readable signal medium may be any machine-readable medium that is not a machine-readable storage medium and that can communicate, propagate, or transport a program for use by or in connection with an instruction execution system, apparatus, or device.

Program code embodied on a machine-readable medium may be transmitted using any appropriate medium, including but not limited to wireless, wireline, optical fiber cable, RF, etc., or any suitable combination of the foregoing.

Computer program code for carrying out operations for aspects of the disclosure may be written in any combination of one or more programming languages, including an object oriented programming language such as the Java® programming language, C++ or the like; a dynamic programming language such as Python; a scripting language such as Perl programming language or PowerShell script language; and conventional procedural programming languages, such as the "C" programming language or similar programming languages. The program code may execute entirely on a stand-alone machine, may execute in a distributed manner across multiple machines, and may execute on one machine while providing results and or accepting input on another machine.

The program code/instructions may also be stored in a machine-readable medium that can direct a machine to function in a particular manner, such that the instructions stored in the machine-readable medium produce an article of manufacture including instructions which implement the function/act specified in the flowchart and/or block diagram block or blocks.

Using the apparatus, systems, and methods disclosed herein may provide the ability to monitor changes in down hole particles (e.g., cuttings), so that the impact of drilling fluid properties and activities in the field can be assessed immediately. This ability may be used to increase efficiency by redirecting pumping and drilling operations in real-time.

Further examples include:

Example 1 is well system for handling downhole particles. The well system includes a mud pump, a shaker, a drill string, an imaging device, and a data acquisition system. The shaker includes a corrugated shaker screen. The drill string is in fluid communication with the mud pump and the shaker. The imaging device is operable to capture images over a period of time of the downhole particles as the downhole particles move across the corrugated shaker screen. The data acquisition system is in electronic communication with the imaging device and includes a processor. The processor is programmed to determine a cross-sectional area of a portion of the corrugated shaker screen occupied by the downhole particles in a first image of the images based on the first image, on a known profile of corrugations of the corrugated shaker screen, a known distance between the imaging device and the corrugated shaker screen, and a known angle between the imaging device and the corrugated shaker screen. The processor is further programmed to determine a volume of the downhole particles on the portion of the corrugated shaker screen in the first image based on the cross sectional area occupied by downhole particles, a velocity of the downhole particles moving across the corrugated shaker screen, and an image generation rate.

In Example 2, the embodiments of any preceding paragraph or combination thereof further include wherein the processor is further programmed to determine an actual cumulative volume of downhole particles moving across the corrugated shaker screen over the period of time by adding together the volume of downhole particles in multiple images.

In Example 3, the embodiments of any preceding paragraph or combination thereof further include wherein the processor is also programmed determine a projected volume of downhole particles over the period of time. The processor is further programmed to determine if a difference between the actual cumulative volume of downhole particles and the projected volume of downhole particles exceeds an error threshold.

In Example 4, the embodiments of any preceding paragraph or combination thereof further include wherein the processor is further programmed to output a notification of a downhole condition occurring based on the error threshold determination.

In Example 5, the embodiments of any preceding paragraph or combination thereof further include wherein the processor is further programmed to modify operation of the well system based on the error threshold determination.

In Example 6, the embodiments of any preceding paragraph or combination thereof further include wherein the downhole particles comprise proppant particles.

Example 7 is method of performing well operations. The method includes capturing images of downhole particle over a period of time via an imaging device as the downhole particles move across a corrugated shaker screen. The method also includes determining, via a processor, a cross-sectional area of a portion of the corrugated shaker screen that is occupied by downhole particles in a first image of the images based the first image, on a known profile of corrugations of the corrugated shaker screen, a known distance between the imaging device and the corrugated shaker screen, and a known angle between the imaging device and the corrugated shaker screen. The method further includes determining, via the processor, a volume of the downhole particles on the portion of the corrugated shaker screen based on the cross sectional area that is occupied by downhole particles, a velocity of the downhole particles, and an image generation rate.

In Example 8, the embodiments of any preceding paragraph or combination thereof further include determining an actual cumulative volume of downhole particles moving across the corrugated shaker screen over the period of time by adding together the volume of downhole particles in multiple images.

In Example 9, the embodiments of any preceding paragraph or combination thereof further include determine a projected volume of downhole particles over the period of time. The method further includes determine if a difference between the actual cumulative volume of downhole particles and the projected volume of downhole particles exceeds an error threshold.

In Example 10, the embodiments of any preceding paragraph or combination thereof further include outputting a notification of a downhole condition occurring based on the error threshold determination.

In Example 11, the embodiments of any preceding paragraph or combination thereof further include modifying the well operations based on the error threshold determination.

In Example 12, the embodiments of any preceding paragraph or combination thereof further include wherein the well operations comprise drilling a well.

In Example 13, the embodiments of any preceding paragraph or combination thereof further include wherein the well operations comprise fracturing a well.

In Example 14, the embodiments of any preceding paragraph or combination thereof further include wherein the downhole particles comprise proppant particles.

Example 15 is system for determining a volume of downhole particles on a corrugated shaker screen of a well system. The system includes an imaging device operable to capture images over a period of time of the downhole particles as the downhole particles move across the corrugated shaker screen. The system also includes a data acquisition system in electronic communication with the imaging device and including a processor. The processor is programmed to determine a cross-sectional area of a portion of the corrugated shaker screen that is occupied by downhole particles in an image of the images based the image, on a known profile of corrugations of the corrugated shaker screen, a known distance between the imaging device and the corrugated shaker screen, and a known angle between the imaging device and the corrugated shaker screen. The processor is further programmed to determine a volume of the downhole particles on the portion of the corrugated shaker screen based on the cross sectional area that is occupied by downhole particles, a velocity of the downhole particles, and an image generation rate.

In Example 16, the embodiments of any preceding paragraph or combination thereof further include wherein the processor is further programmed to determine an actual cumulative volume of downhole particles moving across the corrugated shaker screen over the period of time by adding together the volume of downhole particles in multiple images.

In Example 17, the embodiments of any preceding paragraph or combination thereof further include wherein the processor is also programmed to determine a projected volume of downhole particles over the period of time. The processor is further programmed to determine if a difference between the actual cumulative volume of downhole particles and the projected volume of downhole particles exceeds an error threshold.

In Example 18, the embodiments of any preceding paragraph or combination thereof further include wherein the processor is further programmed to output a notification of a downhole condition occurring based on the error threshold determination.

In Example 19, the embodiments of any preceding paragraph or combination thereof further include wherein the processor is further programmed to modify operation of the well system based on the error threshold determination.

In Example 20, the embodiments of any preceding paragraph or combination thereof further include wherein the downhole particles are proppant particles.

As used herein, the term "approximately" includes all values within 5% of the target value; e.g., approximately 100 includes all values from 95 to 105, including 95 and 105.

For the embodiments and examples above, a non-transitory machine-readable storage device can comprise instructions stored thereon, which, when performed by a machine, cause the machine to perform operations, the operations comprising one or more features similar or identical to features of methods and techniques described above. The physical structures of such instructions may be operated on by one or more processors. A system to implement the described algorithm may also include an electronic apparatus and a communications unit. The system may also include a bus, where the bus provides electrical conductivity among the components of the system. The bus can include an address bus, a data bus, and a control bus, each independently configured. The bus can also use common conductive lines for providing one or more of address, data, or control, the use of which can be regulated by the one or more processors. The bus can be configured such that the components of the system can be distributed. The bus may also be arranged as part of a communication network allowing communication with control sites situated remotely from system.

In various embodiments of the system, peripheral devices such as displays, additional storage memory, and/or other control devices that may operate in conjunction with the one or more processors and/or the memory modules. The peripheral devices can be arranged to operate in conjunction with display unit(s) with instructions stored in the memory module to implement the user interface to manage the display of the anomalies. Such a user interface can be operated in conjunction with the communications unit and the bus. Various components of the system can be integrated such that processing identical to or similar to the processing schemes discussed with respect to various embodiments herein can be performed.

As used herein, the term "electronic communication" includes both wired communication between electronic components and/or electronic devices and wireless communication be between electronic components and/or electronic devices. "Electronic communication" also includes electronic components and/or electronic devices that are in wired or wireless electronic communication via intermediate electronic components and/or electronic devices.

In an effort to provide a concise description of these embodiments, all features of an actual implementation may not be described in the specification. It should be appreciated that in the development of any such actual implementation, as in any engineering or design project, numerous implementation-specific decisions must be made to achieve the developers' specific goals, such as compliance with system-related and business-related constraints, which may vary from one implementation to another. Moreover, it should be appreciated that such a development effort might be complex and time-consuming, but would nevertheless be a routine undertaking of design, fabrication, and manufacture for those of ordinary skill having the benefit of this disclosure.

Certain terms are used throughout the description and claims to refer to particular features or components. As one skilled in the art will appreciate, different persons may refer to the same feature or component by different names. This document does not intend to distinguish between components or features that differ in name but not function.

Reference throughout this specification to "one embodiment," "an embodiment," "an embodiment," "embodiments," "some embodiments," "certain embodiments," or similar language means that a particular feature, structure, or characteristic described in connection with the embodiment may be included in at least one embodiment of the present disclosure. Thus, these phrases or similar language throughout this specification may, but do not necessarily, all refer to the same embodiment.

The embodiments disclosed should not be interpreted, or otherwise used, as limiting the scope of the disclosure, including the claims. It is to be fully recognized that the different teachings of the embodiments discussed may be employed separately or in any suitable combination to produce desired results. In addition, one skilled in the art will understand that the description has broad application, and the discussion of any embodiment is meant only to be exemplary of that embodiment, and not intended to suggest that the scope of the disclosure, including the claims, is limited to that embodiment.

What is claimed is:

1. A well system for handling downhole particles, comprising:

a mud pump;

a shaker comprising a corrugated shaker screen;

a drill string in fluid communication with the mud pump and the shaker;

an imaging device operable to capture images over a period of time of the downhole particles as the downhole particles move across the corrugated shaker screen; and a data acquisition system in electronic communication with the imaging device and comprising a processor programmed to:

determine a cross-sectional area of a portion of the corrugated shaker screen occupied by the downhole particles in a first image of the images based on the first image, on a known profile of corrugations of the corrugated shaker screen, a known distance between the imaging device and the corrugated shaker screen, and a known angle between the imaging device and the corrugated shaker screen; and determine a volume of the downhole particles on the portion of the corrugated shaker screen in the first image based on the cross-sectional area occupied by the downhole particles, a velocity of the downhole particles moving across the corrugated shaker screen, and an image generation rate.

2. The well system of claim 1, wherein the processor is further programmed to determine an actual cumulative volume of downhole particles moving across the corrugated shaker screen over the period of time by adding together the volume of downhole particles in multiple images.

3. The well system of claim 2, wherein the processor is further programmed to:

determine a projected volume of downhole particles over the period of time; and determine if a difference between the actual cumulative volume of downhole particles and the projected volume of downhole particles exceeds an error threshold.

4. The well system of claim 3, wherein the processor is further programmed to output a notification of a downhole condition occurring based on the error threshold determination.

5. The well system of claim 3, wherein the processor is further programmed to modify operation of the well system based on the error threshold determination.

6. The well system of claim 1, wherein the downhole particles comprise proppant particles.

7. A method of performing well operations, the method comprising:

capturing images of downhole particles over a period of time via an imaging device as the downhole particles move across a corrugated shaker screen;

determining, via a processor, a cross-sectional area of a portion of the corrugated shaker screen that is occupied by the downhole particles in a first image of the images based the first image, on a known profile of corrugations of the corrugated shaker screen, a known distance between the imaging device and the corrugated shaker screen, and a known angle between the imaging device and the corrugated shaker screen; and determining, via the processor, a volume of the downhole particles on the portion of the corrugated shaker screen based on the cross-sectional area that is occupied by the downhole particles, a velocity of the downhole particles, and an image generation rate.

8. The method of claim 7, further comprising determining an actual cumulative volume of downhole particles moving across the corrugated shaker screen over the period of time by adding together the volume of downhole particles in multiple images.

9. The method of claim 8, further comprising:

determine a projected volume of downhole particles over the period of time; and determine if a difference between the actual cumulative volume of downhole particles and the projected volume of downhole particles exceeds an error threshold.

10. The method of claim 9, further comprising outputting a notification of a downhole condition occurring based on the error threshold determination.

11. The method of claim 9, further comprising modifying the well operations based on the error threshold determination.

12. The method of claim 7, wherein the well operations comprise drilling a well.

13. The method of claim 7, wherein the well operations comprise fracturing a well.

14. The method of claim 7, wherein the downhole particles comprise proppant particles.

15. A system for determining a volume of downhole particles on a corrugated shaker screen of a well system, the system comprising:

an imaging device operable to capture images over a period of time of the downhole particles as the downhole particles move across the corrugated shaker screen; and a data acquisition system in electronic communication with the imaging device and comprising a processor programmed to:

determine a cross-sectional area of a portion of the corrugated shaker screen that is occupied by the downhole particles in an image of the images based the image, on a known profile of corrugations of the corrugated shaker screen, a known distance between the imaging device and the corrugated shaker screen, and a known angle between the imaging device and the corrugated shaker screen; and determine a volume of the downhole particles on the portion of the corrugated shaker screen based on the cross-sectional area that is occupied by the downhole particles, a velocity of the downhole particles, and an image generation rate.

16. The system of claim 15, wherein the processor is further programmed to determine an actual cumulative volume of downhole particles moving across the corrugated shaker screen over the period of time by adding together the volume of downhole particles in multiple images.

17. The system of claim 16, wherein the processor is further programmed to:

determine a projected volume of downhole particles over the period of time; and determine if a difference between the actual cumulative volume of downhole particles and the projected volume of downhole particles exceeds an error threshold.

18. The system of claim 17, wherein the processor is further programmed to output a notification of a downhole condition occurring based on the error threshold determination.

19. The system of claim 17, wherein the processor is further programmed to modify operation of the well system based on the error threshold determination.

20. The system of claim 15, wherein the downhole particles are proppant particles.

* * * * *